US005154144A

United States Patent [19]

Okui et al.

[11] Patent Number: 5,154,144

[45] Date of Patent: Oct. 13, 1992

[54] CAMSHAFT DRIVE ARRANGEMENT FOR ENGINE

[75] Inventors: Kaoru Okui; Manabu Kobayashi, both of Iwata, Japan

[73] Assignee: Yamaha Hatsudoki Kabushiki Kaisha, Japan

[21] Appl. No.: 782,745

[22] Filed: Oct. 18, 1991

Related U.S. Application Data

[63] Continuation of Ser. No. 570,314, Aug. 21, 1990, abandoned, which is a continuation-in-part of Ser. No. 270,357, Nov. 14, 1988, Pat. No. 5,024,287, and a continuation-in-part of Ser. No. 346,545, May 2, 1989, Pat. No. 5,050,701.

[30] Foreign Application Priority Data

Aug. 23, 1989 [JP] Japan ..... 1-216994

[51] Int. Cl.[5] ..... F01L 1/02

[52] U.S. Cl. ..... 123/90.27; 123/90.31

[58] Field of Search ..... 123/90.27, 90.31, 195 R, 123/195 L, 59 R, 59 A, 198 E

[56] References Cited

U.S. PATENT DOCUMENTS 3,673,990 7/1972 Alfieri ..... 123/90.27
4,658,769 4/1987 Horio et al. ..... 123/90.27
4,745,887 5/1988 Ito et al. ..... 123/90.31
4,750,455 6/1988 Ebesu ..... 123/90.31
4,753,199 6/1988 Melde-Tuczai et al. ..... 123/90.31

*Primary Examiner*—Noah P. Kamen
*Attorney, Agent, or Firm*—Ernest A. Beutler

[57] ABSTRACT

A vehicle and drive unit therefor including a transversely disposed engine located in an engine compartment. The cylinders are inclined to the rear from a vertical plane at an acute angle and the engine crankshaft drives an accessory output shaft that rotates in a plane disposed in an acute angle to the vertical and forwardly of the cylinder axis and at an acute angle to the cylinder axis. A two-stage camshaft drive arrangement is provided for driving a pair of overhead mounted camshafts and the two stages of this drive include flexible transmitters that are disposed on opposite sides of one of the cylinders so as to provide a compact assembly. An intermediate shaft is driven by this drive arrangement and is supported at one side of the cylinder head. One of the drives is disposed between a pair of ports in this side of the cylinder head and this drive is accessible through a removable cover plate positioned between the ports.

60 Claims, 12 Drawing Sheets

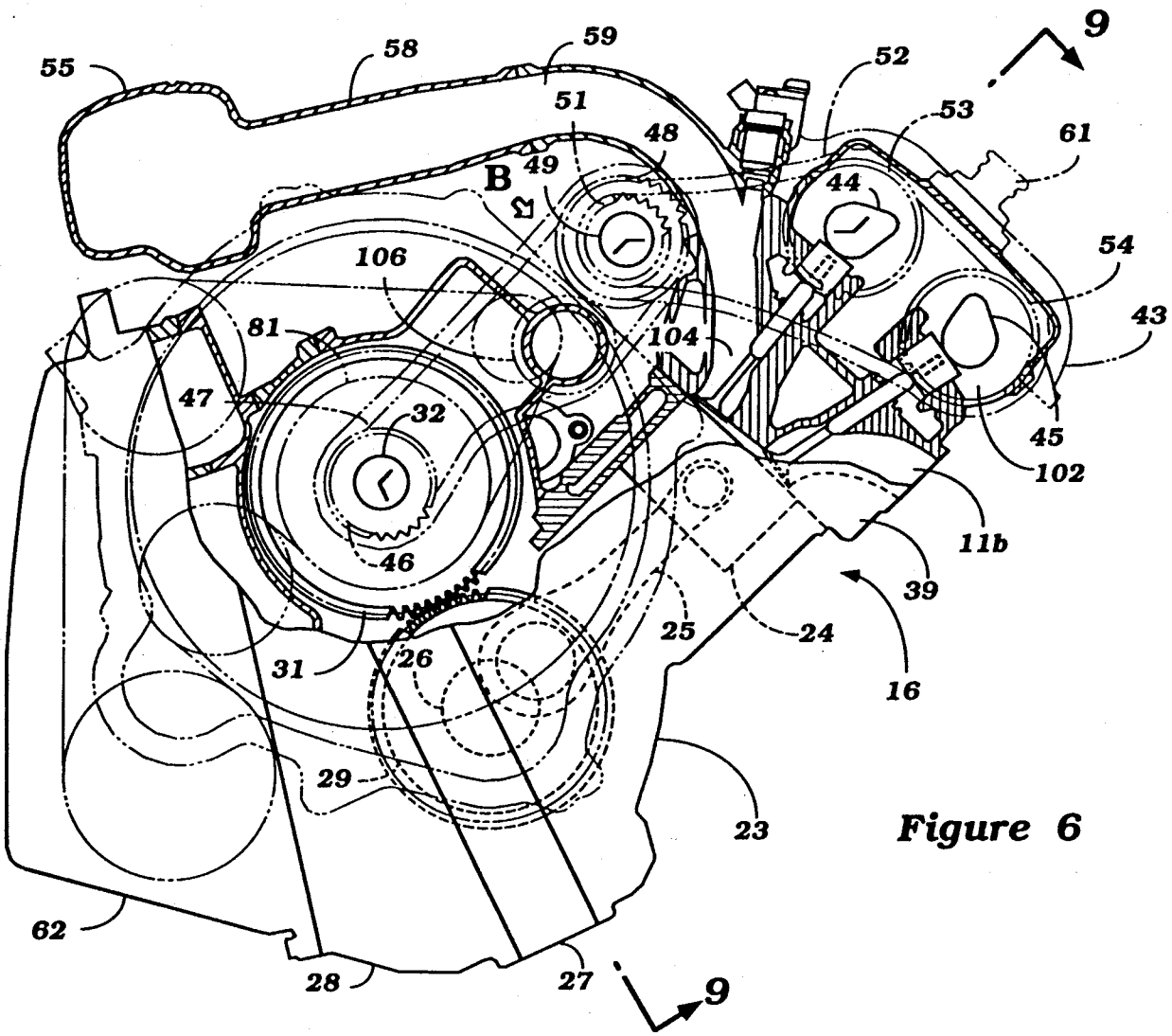
Figure 6
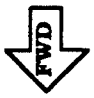

CAMSHAFT DRIVE ARRANGEMENT FOR ENGINE

CROSS REFERENCE TO RELATED APPLICATIONS

This is a continuation of U.S. Pat. application Ser. No. 570,314, filed Aug. 21, 1990, now abandoned, which is a continuation-in-part of our applications Ser. No. 270,357, filed Nov. 14, 1988, now U.S. Pat. No. 5,024,287, entitled "Engine Unit for Vehicles" and Ser. No. 346,545, filed May 2, 1989, now U.S. Pat. No. 5,050,701, entitled "Front Wheel Drive Engine", which applications are assigned to the assignee hereof.

BACKGROUND OF THE INVENTION

This invention relates to a camshaft drive arrangement for an engine and more particularly to an improved compact highly serviceable camshaft drive arrangement for an engine.

As is well known, engines, particularly those employed in motor vehicles have become increasingly complex and complicated in nature. In addition to the complexity of the engine itself, the placement of the engine in the engine compartment has added further demands on the designer. Specifically, it is desirable to maintain a low hood line so as to improve wind resistance and fuel economy. However, this problem is greatly complicated by the complexity of the engine and its accessories and components. In addition to these problems, it is frequently the practice to place the engine transversely in the engine compartment and closely adjacent the axles which are driven by the engine. This gives rise to a number of additional problems.

As noted in our copending applications, certain advantages can be enjoyed by having the engine crankshaft drive an output shaft that is mounted to one side of the engine and which drives the axles on the other side of the engine. However, this type of drive arrangement may give rise to certain problems in connection with the camshaft drive of the engine. As noted in those aforenoted applications, the camshaft drive can be made more compact if the camshafts are driven in two stages from the engine output shaft via an intermediate shaft that is mounted adjacent the upper end of the cylinder block.

In connection with such a placement for the camshaft drive and intermediate shaft, however, certain additional problems are encountered. Specifically, it is desirable to place the drives in two different locations rather than have the two drive trains both located at the end of the engine and extending beyond it. That is, if the camshaft drive arrangements are located at the end of the engine and extend beyond the end, the overall engine length will be increased.

However, if part of the camshaft drive mechanism is located inwardly from the end of the engine, then additional problems are encountered. Specifically, if the camshaft drive is positioned between a pair of the cylinders, the drive mechanism for the camshaft may encroach into the cylinder block and the fastening arrangements between the cylinder block and the cylinder head. In addition, with cross flow cylinder heads the camshaft drive can also encroach on the porting associated with the engine.

It is, therefore, a principal object of this invention to provide an improved and compact camshaft drive arrangement for an engine.

It is a further object of this invention to provide a camshaft drive arrangement for an engine wherein the drive is accomplished in successive stages and at least a portion of the drive is not located at the extreme end of the engine.

It is a further object of this invention to provide a staged camshaft drive arrangement for an engine that will permit a compact construction and yet will not interfere with the other components of the engine.

In addition to the problems of placement of the camshaft drive already described, there is also the design factor that frequently it is necessary to access a portion of the camshaft drive mechanism for servicing purposes. That is, if the drive employs belts or chains, replacement of those components may be required. In addition, when servicing other components of the engine it may be necessary to access the camshaft drive so as to retime the camshafts relative to the engine crankshaft. By employing a staged camshaft drive of the type as aforedescribed, these accessibility problems also become more complicated.

It is, therefore, a still further object of this invention to provide a improved camshaft drive arrangement for an engine that permits a compact engine construction but which nevertheless is easily accessible for servicing.

When the engine is of the type of construction having the output shaft be a shaft other than the crankshaft of the engine, then that output shaft tends to be in a location in closer proximity to the camshaft drive arrangement. It is important, however, to be able to provide a large flywheel for the output shaft so as to accommodate a clutch or torque converter of adequately size to handle the power of the engine. However, if the camshaft drive is positioned in proximity to this end of the engine, then further enlargement of the flywheel may be hampered.

It is, therefore, a yet further object of this invention to provide an improved engine arrangement having an output shaft driven by the engine crankshaft and a camshaft drive arrangement that is positioned so that it will not interfere with the use of a large flywheel on the engine output shaft.

SUMMARY OF THE INVENTION

A first feature of this invention is adapted to be embodied in a camshaft drive arrangement for an engine having at least one cylinder. A crankshaft is driven by a piston contained within the one cylinder for rotation about a first axis. An intermediate shaft is journaled for rotation about a second axis parallel to the first axis and first drive means drive the intermediate shaft from the crankshaft on one side of a plane extending perpendicularly to the first and second axes and containing the axis of the cylinder. A camshaft is journaled for rotation about a third axis parallel to the first and second axes for operating at least one valve associated with the cylinder. Second drive means drive the camshaft from the intermediate shaft on the other side of the aforenoted plane.

Another feature of the invention is adapted to be embodied in a camshaft drive and cylinder head arrangement for an internal combustion engine that comprises a camshaft journaled for rotation by the cylinder head for operating at least one valve located therein. An intermediate shaft is journaled for rotation by the cylinder head at one side thereof. First drive means are provided for driving the intermediate shaft from an output shaft of the engine and second means drive the camshaft from the intermediate shaft. One of the drive means is located at one end of the cylinder head and the other of the drive means is spaced from the one end of the cylinder head and remote from the other end thereof. Removable access means are carried by the cylinder head and offer access to the other drive means for service purposes.

Yet another feature of the invention is also adapted to be embodied in a camshaft drive and cylinder head arrangement for an internal combustion engine comprising a camshaft journaled for rotation by the cylinder head and operating at least one valve located therein. An intermediate shaft is journaled for rotation by the cylinder head at one side thereof and ports of the engine open through that one side of the cylinder head. First drive means are provided for driving the intermediate shaft from an output shaft of the engine and second means drive the camshaft from the intermediate shaft. One of the drive means is located at one end of the cylinder head and the other of the drive means is spaced from the one end of the cylinder head and remotely from the other end thereof. This other drive means is nested between a pair of ports of the cylinder head.

Yet a further feature of the invention is adapted to be embodied in a camshaft drive arrangement for an internal combustion engine having an output shaft driven by the engine about a first axis. A flywheel is affixed for rotation at one end of the output shaft. A intermediate shaft is journaled by the engine for rotation about a second axis parallel to the first axis. Means offset from the flywheel are provided for driving the intermediate shaft from the output shaft adjacent the one end thereof. A camshaft is journaled for rotation about a third axis parallel to the first and second axes and means adjacent but offset from the flywheel drive the camshaft from the intermediate shaft.

BRIEF DESCRIPTION OF THE DRAWINGS

FIG. 6 is a further view similar to FIG. 5, but with other portions of the engine broken away to show other details thereof and on a somewhat reduced scale.

DETAILED DESCRIPTION OF THE PREFERRED EMBODIMENTS OF THE INVENTION

Figure 1:
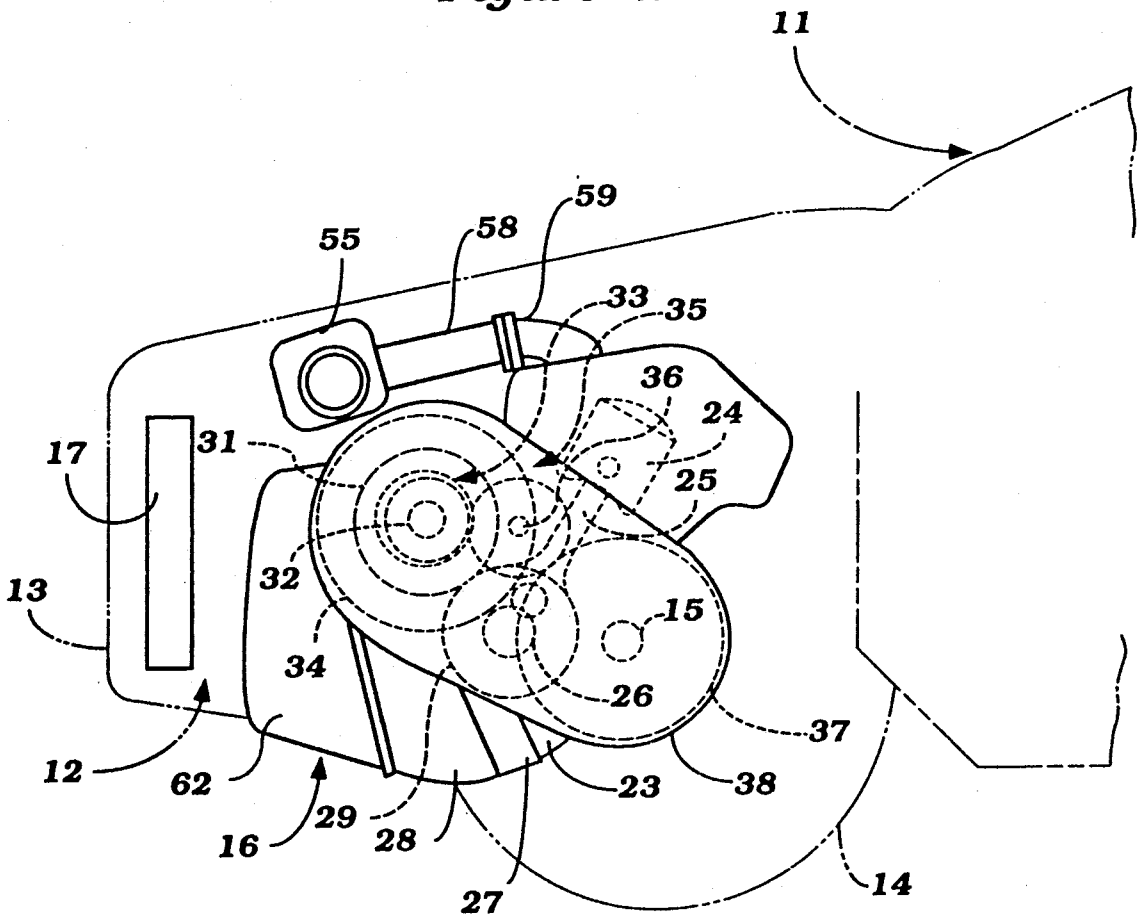
FIG. 1 is a side elevational view of a portion of a motor vehicle embodying an engine construction in accordance with an embodiment of the invention, with portions of the vehicle shown in phantom.
Figure 2:
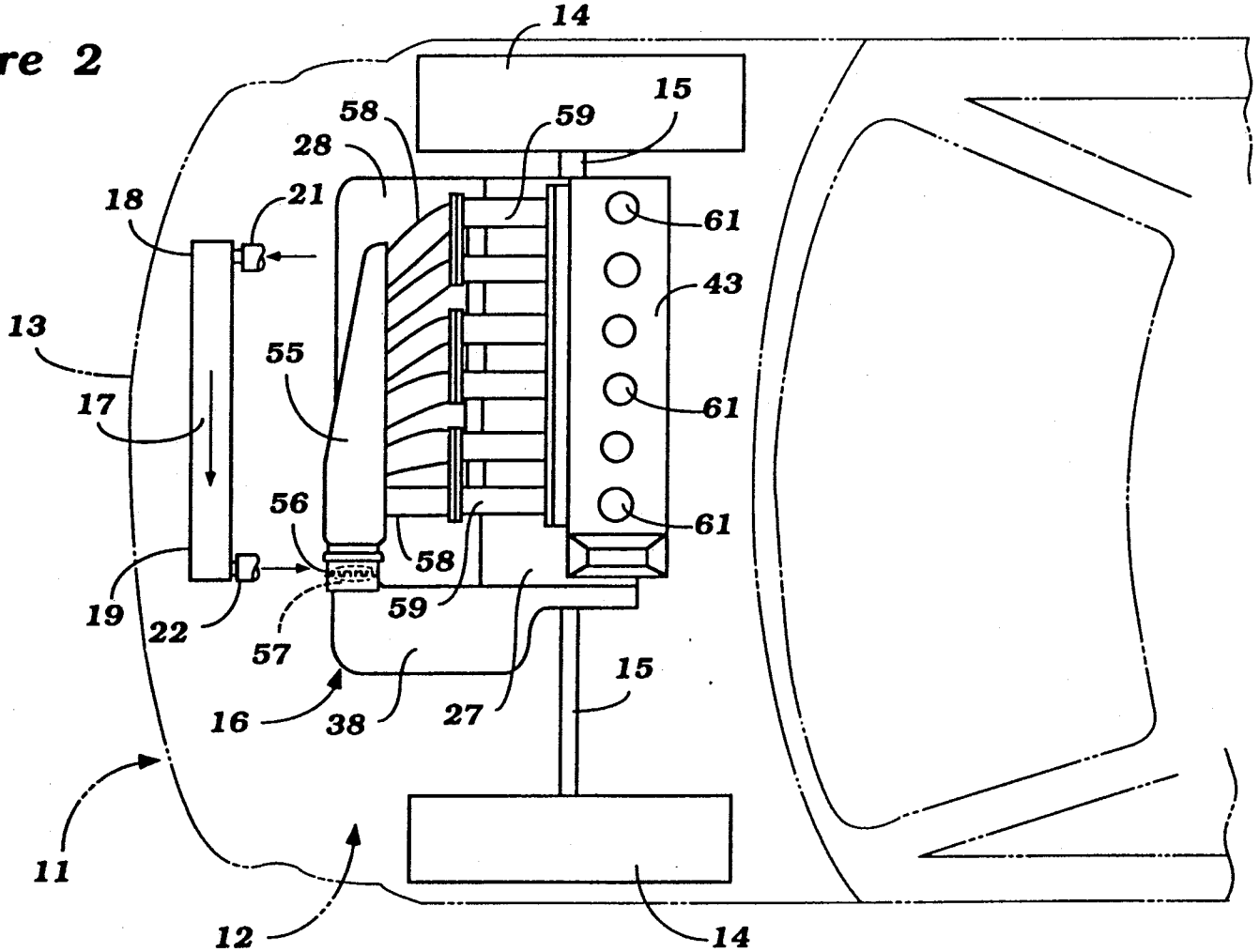
FIG. 2 is a top plan view of the portion of the vehicle shown in FIG. 1 with portions of the vehicle shown in phantom.

Referring first in detail to FIGS. 1 and 2, a motor vehicle powered by an engine constructed in accordance with an embodiment of the invention is shown primarily in phantom and is identified generally by the reference numeral 11. Only the portion of the motor vehicle 11 associated with the engine compartment has been illustrated because the invention deals with the engine construction and its placement in this engine compartment and the camshaft drive arrangement therefor.

In the illustrated embodiment, the vehicle 11 is of the front engine transversely disposed front wheel drive type and has an engine compartment 12 that extends transversely across the front of the motor vehicle 11 and which is positioned rearwardly of an air inlet opening 13 which is formed in the body of the vehicle forwardly of the engine compartment 12. A pair front wheels 14 are suspended by the chassis of the vehicle 11 in a known manner and have associated with them axle shafts 15 which are driven in a manner to be described.

A power unit, indicated generally by the reference numeral 16 and which is comprised of an internal combustion engine, a change speed transmission, and a final drive, is positioned transversely in the engine compartment 12 for driving the axle shafts 15. Basically, the power unit 16 has a construction as described in our aforenoted copending application Ser. No. 270,357 and specifically the embodiment of FIGS. 6 through 8 thereof. Because of the basic similarity of the engine of this embodiment to that of the previously described embodiment, certain components have not been illustrated fully, nor will they be described in full detail. Where that is the case, reference may be had to the aforenoted copending application, the disclosure of which is incorporated herein by reference.

A radiator 17 of the cross flow type is positioned transversely in the engine compartment 12 directly behind the air inlet opening 13. As a cross flow radiator, the radiator 17 has header tanks 18 and 19 disposed at its opposite ends which receive coolant from the power unit 16 through a hose 21 and which return coolant to the power unit 16 through a hose 22. Other components of the cooling system will be described hereinafter.

Figure 5:
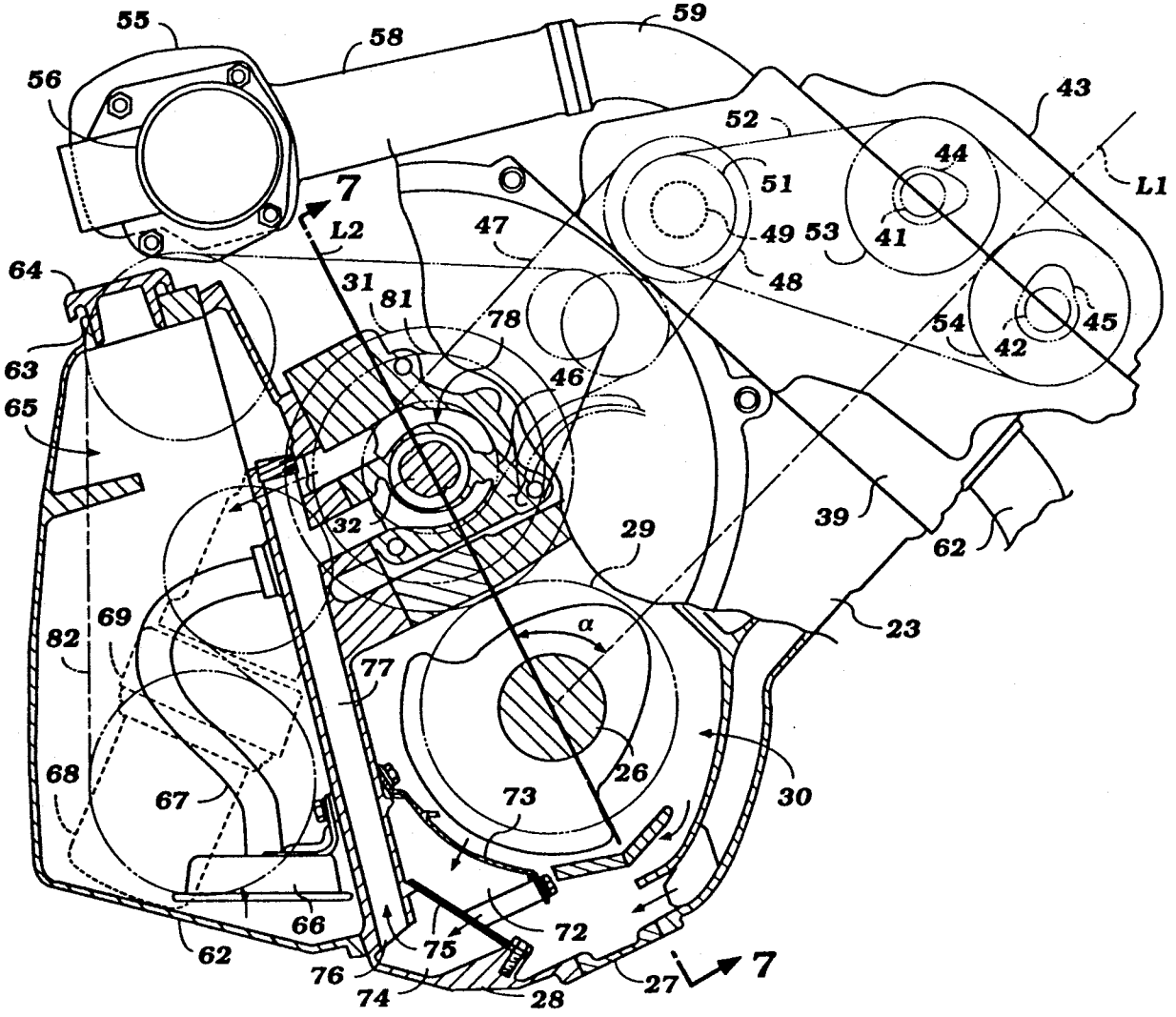
FIG. 5 is a side elevational view, in part similar to FIG. 1, on an enlarged scale and with portions broken away.

The engine portion of the power unit 16 includes a cylinder block 23 that is provided with a plurality of aligned cylinder bores in which pistons 24 reciprocate. The cylinder bores in which the pistons 24 reciprocate are inclined from the vertical rearwardly away from the engine compartment air inlet opening 13 along a line L1 as best seen in FIG. 5. In the illustrated embodiment, the engine has six cylinders although it is to be understood that the invention can be practiced with engines having other numbers of cylinders. The pistons 24 are connected by means of connecting rods 25 for driving a crankshaft 26 that is rotatable about an axis that lies on the line L1 and which is disposed at the lower ends of the cylinders. The crankshaft 26 is rotatably journaled in a known manner.

A first crankcase portion 27 is affixed to the cylinder block 23 at its lower end. However, because of the angular disposition of the cylinder block 23, the crankcase portion 27 extends generally vertically along a line that is disposed at an acute angle to the vertical but which extends forwardly of a vertically extending plane from the line L1. This plane is generally designated by the line L2 and lies at an acute angle to the plane L2. A further crankcase portion 28 is affixed to the portion 27 and also extends vertically upward and is disposed forwardly of the crankcase portion 27. The portions 27 and 28 and the cylinder block 23 define a crankcase chamber 29 in which the crankshaft 26 rotates.

Figure 7:
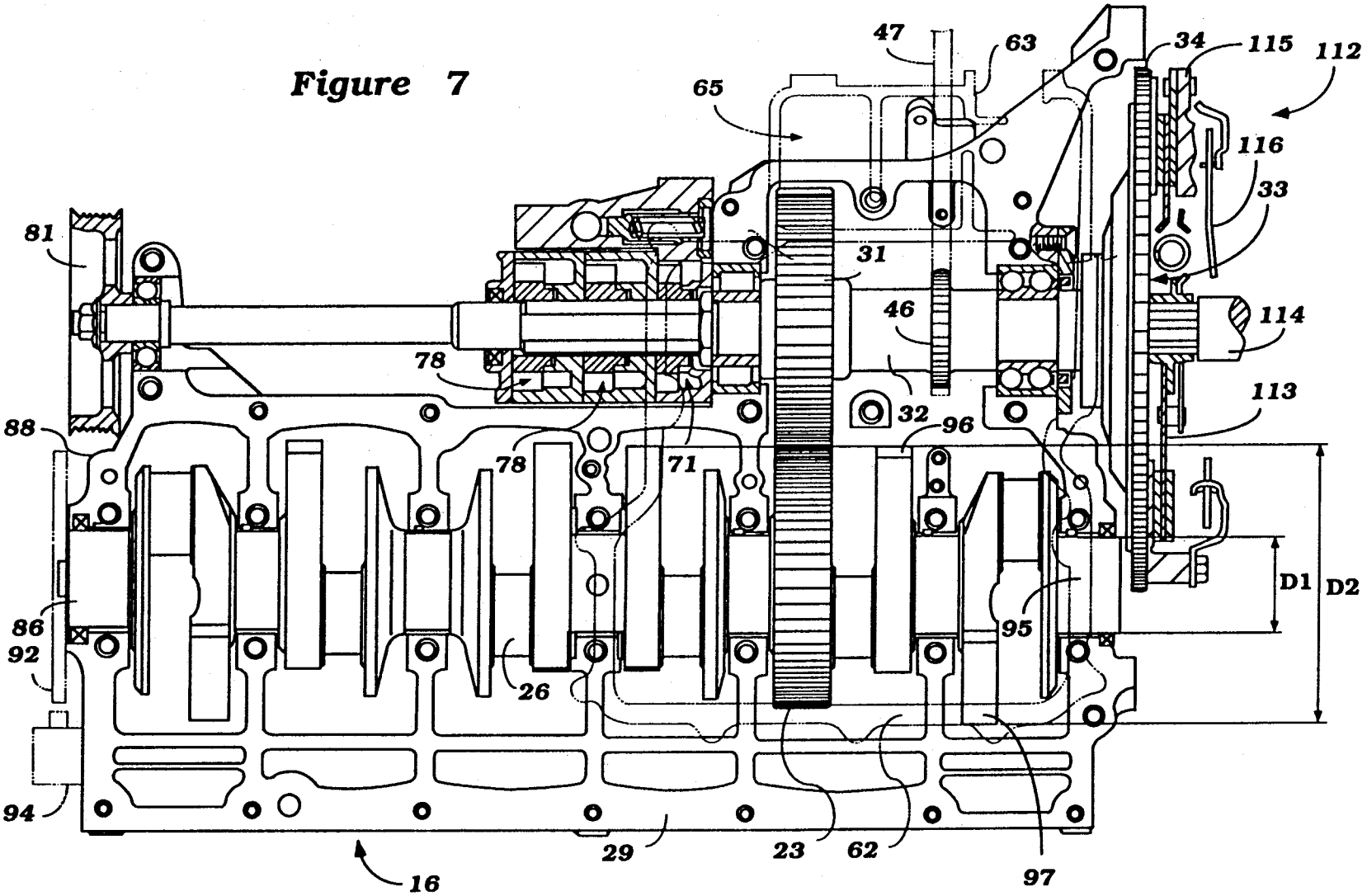
FIG. 7 is a cross-sectional view taken along the line 7—7 of FIG. 5.

As may be seen in FIG. 7, one of the cheeks of the crankshaft 26 is formed with an integral gear portion 29 which is enmeshed with a gear 31 that is affixed to or associated with an accessory or output shaft 32. The accessory or output shaft 32 is supported for rotation by the cylinder block 23 and crankcase portion 27 for rotation about an axis that is disposed parallel to the axis of rotation of the crankshaft 26 and the axle shafts 15, but which lies on the line L2. The line L2 is disposed at an acute angle, as aforenoted, to a vertically extending plane and at an acute angle $\alpha$ relative to the plane L1. This acute angle relationship permits a very compact engine, accessory and final drive assembly, as will become apparent.

With the prior art type of constructions and specifically that shown in our copending application Ser. No. 270,257, the output shaft axis 32 is disposed forwardly and at least at a right angle to the cylinder bore axis defined by the line L1. As a result, this axis is disposed at a relatively low height from the vertical and forwardly of the crankshaft axis. However, by disposing the output shaft angle 32 at an acute angle to the plane L1, the height is raised but the horizontal length of the engine is substantially reduced. As a result and as will be described, this permits a more compact assembly.

A flywheel, indicated generally by the reference numeral 33 and having a starter gear 34 is affixed for rotation with the output shaft 32. The flywheel 33 is associated with a clutch (to be described) for driving a primary shaft of a change speed transmission, indicated generally by the reference numeral 35. The change speed transmission 35 includes a secondary shaft 36 and a plurality of intermeshing gear sets.

The gear sets are contained on the transmission primary shaft and secondary shaft 36 for driving the secondary shaft 36 from the primary shaft at selected speed ratios. The secondary shaft 36 drives an input gear 37 of a differential assembly for driving the axle shafts 15 in a well known manner.

It should be noted that the acute angle between the lines L1 and L2 and the close positioning of the transmission secondary shaft 36 to the line L1 permits a very compact final drive assembly and keeps the distance between the primary shaft of the transmission 35 and the axis of rotation of the axle shafts 15 very close to each other. The close positioning of the output shaft axis and the axles 15 also makes it possible to use smaller diameter gears for the final drive and this further adds to the compactness of the assembly. A transmission casing cover 38 encloses the portion of the transmission which has been described for driving the axle shafts 15. This cover 38 is affixed to the cylinder block 23 and crankcase portions 27 and 28 in a suitable manner.

A cylinder head 39 is affixed in a known manner to the upper end of the cylinder block 23 and closes the cylinder bores in which the pistons 24 reciprocate. Overhead mounted intake and exhaust valves, as described in our copending application Ser. No. 270,357, are mounted in the cylinder head 39 for controlling the admission of an intake charge and the exhaust of the burnt charge. These valves are operated by means of an intake camshaft 41 and an exhaust camshaft 42 that are journaled on the cylinder head assembly 39 and which are enclosed within a cam chamber closed by a cam cover 43. The camshafts 41 and 42 have respective cam lobes 44 and 45 for operating the intake and exhaust valves in the manner described in our aforenoted copending patent application.

A camshaft drive sprocket 46 (FIGS. 7–9) is formed integrally on the accessory or output shaft 32 and drives a first timing chain 47. The first timing chain 47, in turn, drives a sprocket 48 that is affixed to an intermediate cam drive shaft 49. The cam drive shaft is journaled in an appropriate manner on the cylinder head 39 and, in turn, drives a second sprocket 51. A second chain 52 drives a pair of driven sprockets 53 and 54 that are affixed to the camshafts 41 and 42 respectively for driving these camshafts. As noted in our aforenoted copending application, the two to one speed reduction between the crankshaft 26 and camshafts 41 and 42 may be achieved in stages through the camshaft drive mechanism as aforedescribed. Because this mechanism is described in more detail in our copending application, further description of it in this application is not believed to be necessary.

Figure 4:
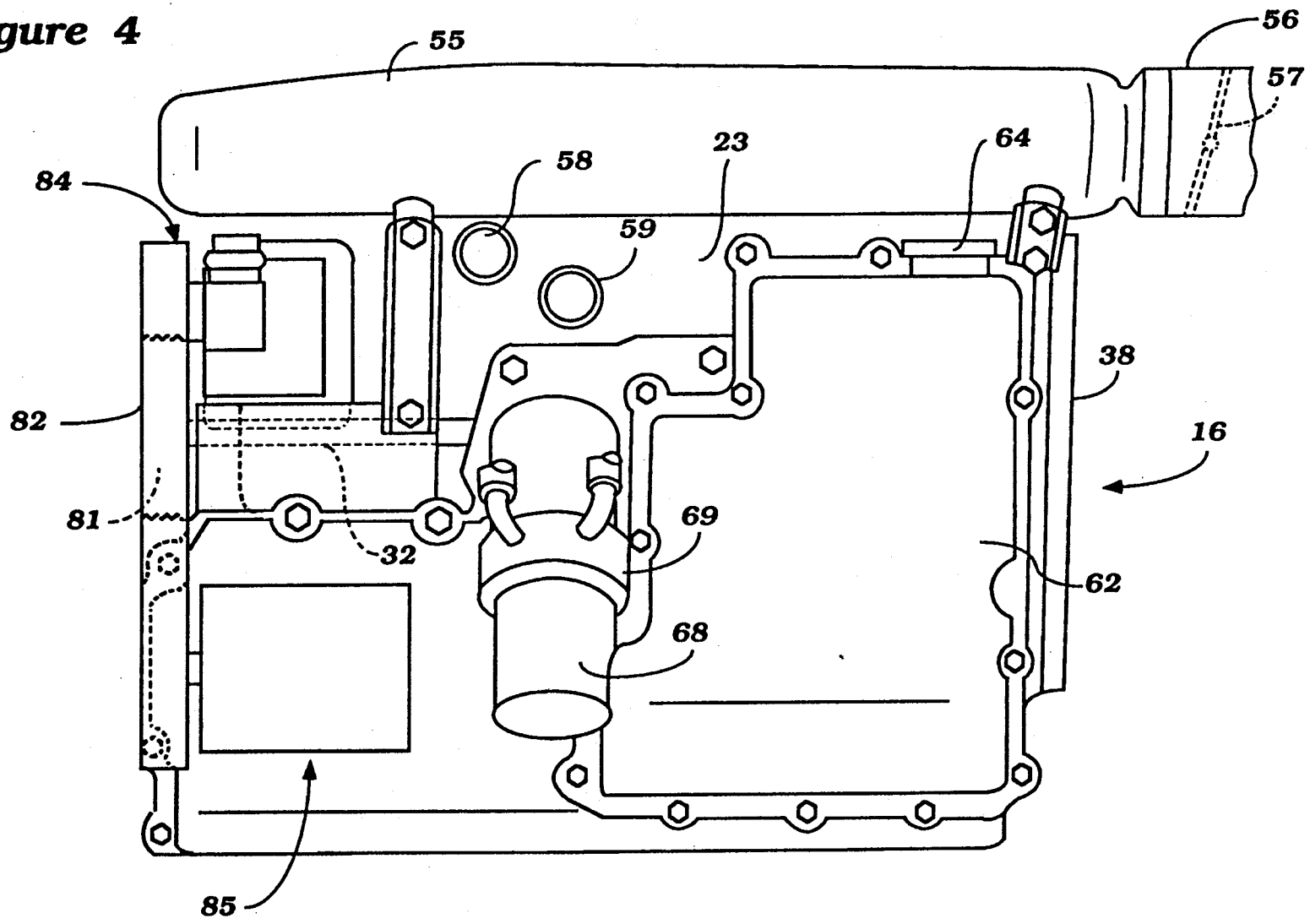
FIG. 4 is an enlarged front elevational view of the engine.

The intake valves, as aforedescribed, are associated with an air induction system that includes a plenum chamber 55 that extends transversely across the engine compartment 12 forwardly of the cylinder head and cylinder block 23. The plenum chamber 55 is provided with an air inlet portion 56 in which a throttle valve 57 (FIGS. 2 and 4) is positioned for controlling the engine speed. Air is delivered to the inlet section 56 from a remotely positioned air cleaner and silencer assembly (not shown).

The plenum chamber 55 has either affixed to it or formed integrally with it a plurality of runners 58 that cooperate with manifold pipes 59 which serve the individual cylinders of the engine and specifically the intake ports of the cylinder head 39 in a known manner.

Spark plugs (not shown) are contained within spark plug pockets 61 formed in the cam cover 43 and are in turn threaded into the cylinder head 39 for firing the charge admitted to the combustion chambers of the engine. The ignition system for firing these spark plugs may be of any known type. The burnt exhaust gases are then discharged through the exhaust ports of the cylinder head 39 to an exhaust manifold, shown partially and indicated by the reference numeral 62.

The engine is provided with a dry sump lubrication system that includes a dry sump lubricant reservoir 62 that is supported from the crankcase member 28 and which extends forwardly of the engine and vertically upwardly in the area to the rear of the air inlet opening 13 to the engine compartment 12. The top of the reservoir 62 has a filler neck 63 to which a detachable cap 64 is attached. The tank 62 has a large internal volume 65 and the filler neck 63 and a portion of the volume 65 extends upwardly beyond the axis of rotation of the engine output shaft 32. As a result, the tank 62 has a large surface area that will be exposed to the cooling air flow. This will insure that the lubricant is well cooled. The greater height and larger volume for the dry sump lubricant reservoir 62 is made possible because of the acute angle relationship between the planes L1 and L2 which has been previously discussed. This permits the tank 62 to be positioned rearwardly in the engine compartment and can have a significant height without adversely effecting the hood line of the vehicle.

A lubricant pressure pump 71 (FIG. 7) of the tricodal type is driven by the accessory shaft 32 and draws oil from the lower portion of the tank 62 through a strainer inlet 66. A conduit 67 extends from the strainer inlet 66 to the inlet side of the pressure pump 71. Lubricant is then delivered from the pressure pump 71 to an oil filter 68 that is mounted on the front of the crankcase casing 28 with an oil cooler 69 being interposed between it and the crankcase member 28. The oil cooler 69 receives coolant from the cooling system including the radiator 17. The lubricant is then delivered to the various components of the engine for their lubrication in a suitable manner.

The lubricant will then return to the crankcase chamber 29 by gravity flow and specifically to an area 72 positioned below a baffle plate 73. The baffle plate 73 is juxtaposed to the crankshaft 26 so as to control the oil flow in this area. The oil will then drain to a well 74 formed below a screen 75. This oil is then picked up by the inlet 76 of a scavenge line 77 that is formed in the crankcase portion 28 for delivery to a pair of scavenge pump assemblies 78. The scavenge pump assemblies 78 are driven from the accessory shaft 32 and are also of the tricodal type. The scavenged oil is then returned to the dry sump tank 62 through a return conduit 79.

An accessory drive pulley 81 is affixed to the end of the accessory or output shaft 32 opposite to the flywheel 33 and drives a belt 82. The belt 82 drives a plurality of accessories such as an alternator 83, power steering pump 84 and air conditioning compressor 85. As may be seen from FIG. 7, the accessory drive pulley 81 is affixed to the accessory drive shaft 32 at a point that is inwardly of the adjacent bearing end 86 of the crankshaft 26 which bearing end is supported in a boss 87 of the cylinder block 23 and crankcase.

There is provided a recess 88 adjacent this area so as to permit the accessory drive shaft 32 to rotate about an axis that is disposed at a very close distance to the axis of rotation of the crankshaft 26. This arrangement also insures that the engine will have a short overall length and that the accessories which are mounted externally of the engine are disposed between its ends to provide a compact assembly. However, due to the angular disposition of the cylinder block 23 and the bores therein, these accessories are readily available for servicing.

It should be noted that the portion of the output or accessory shaft 32 that is driven by the crankshaft 26 and which drives the camshaft mechanism is disposed internally of the body of the engine and specifically of the cylinder block 23. However, the portion of the shaft 32 which drives the pulley 81 and pumps 71 and 78 is external of this body.

Figure 3:
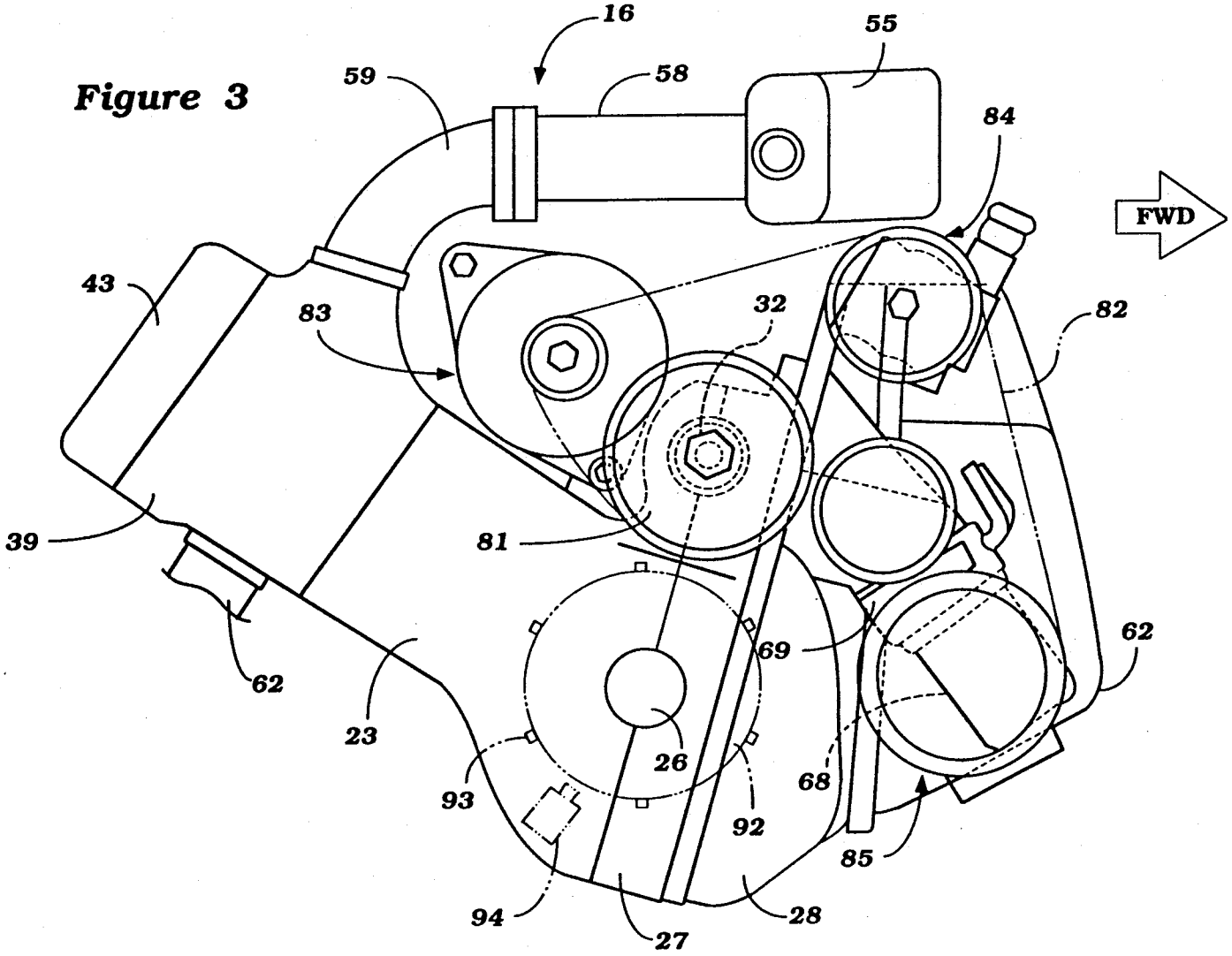
FIG. 3 is an enlarged side elevational view of the engine unit looking in the direction opposite to that shown in FIG. 1.

In conjunction with the ignition system for the engine, a timer disk or wheel 92 (FIGS. 3 and 7) is affixed to the end of the crankshaft 26 adjacent the accessory drive pulley 81 and carries a marker 93 that cooperates with a fixed pulser coil 94 so as to provide an indication of crankshaft rotation.

Figure 8:
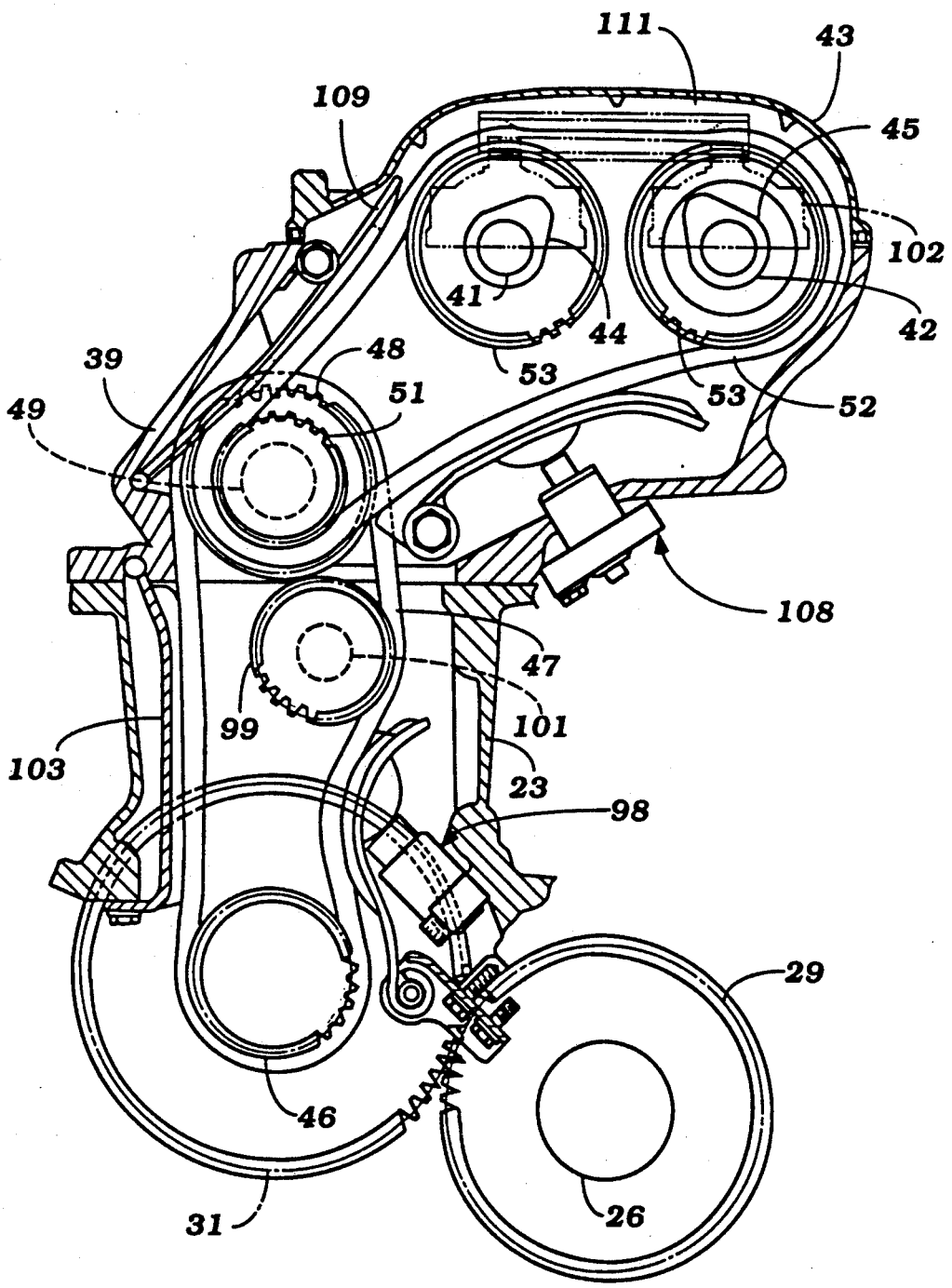
FIG. 8 is a cross-sectional view taken through the camshaft drive assembly.
Figure 9:
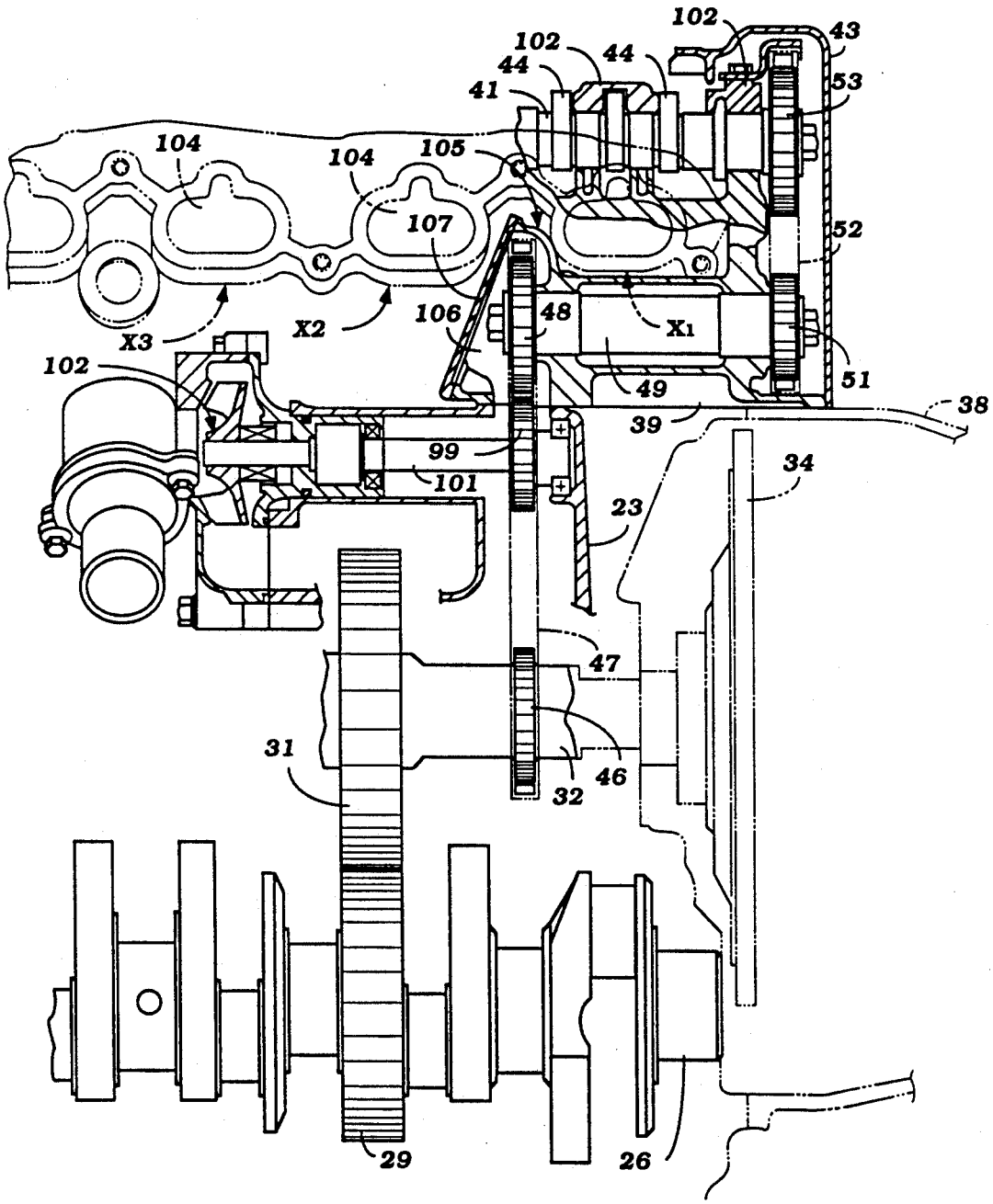
FIG. 9 is a side elevational view of the camshaft drive assembly and showing its relationship to the intake ports of the engine, as shown in phantom and also the relationship to the flywheel shown in phantom and is taken generally along the line 9—9 of FIG. 6.
Figure 10:
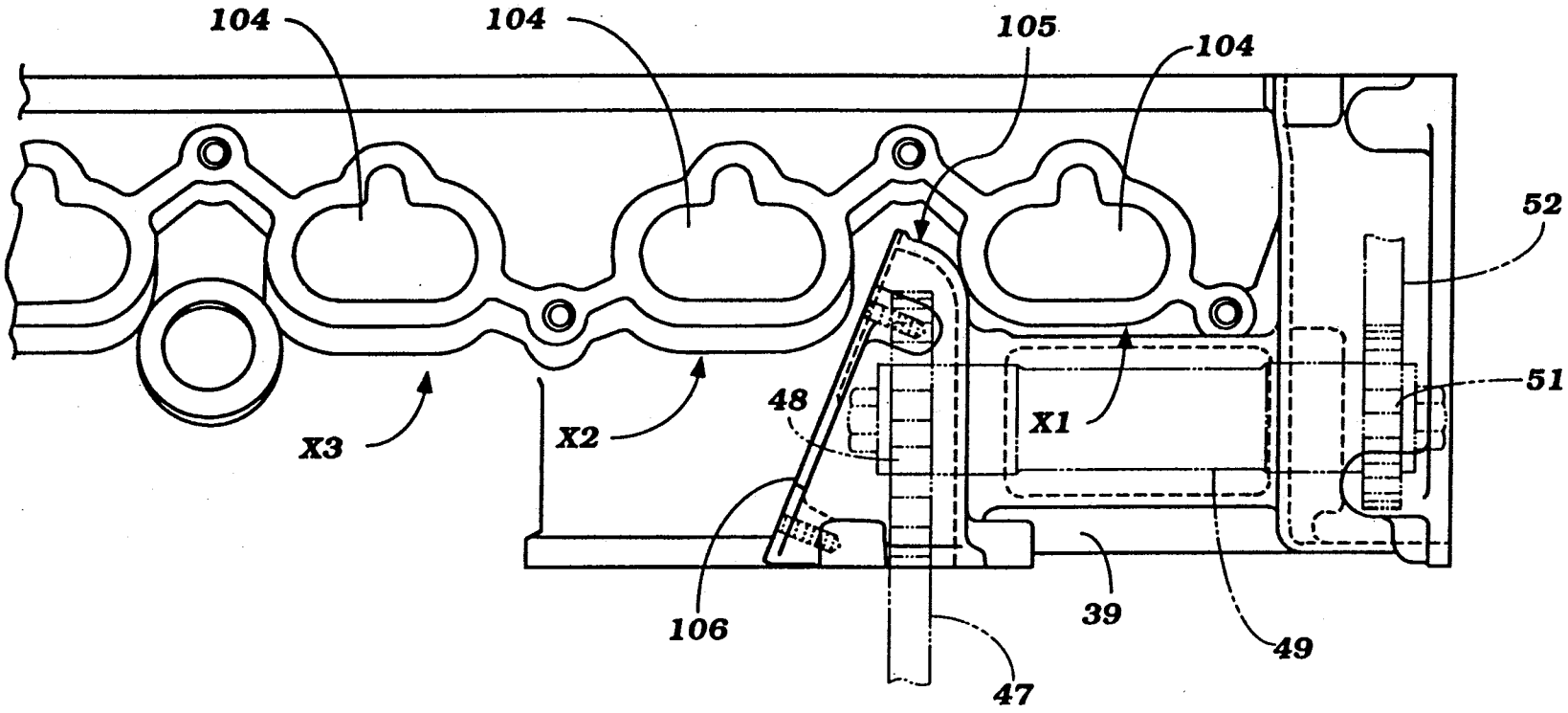
FIG. 10 is an enlarged side elevational view of the cylinder head assembly with the intake manifold removed to show the arrangement of the intermediate drive shaft and the access therefor.
Figure 11:
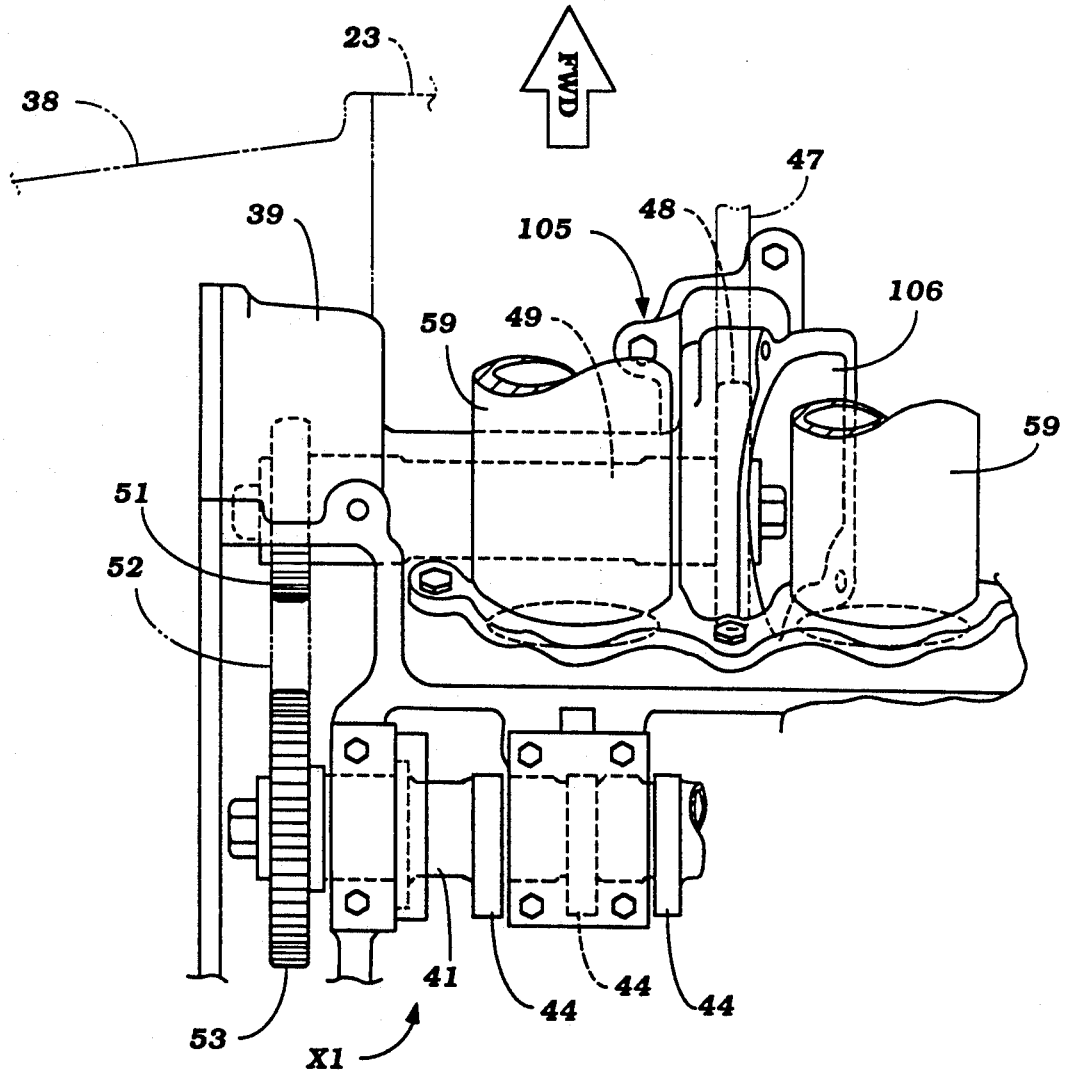
FIG. 11 is a top plan view of the camshaft drive end of the engine with portions removed and other portions broken away.

Referring again to the camshaft drive mechanism and particularly to FIGS. 7-9, it should be noted that the driving sprocket 46 for the first chain drive 47 is spaced inwardly from the flywheel 33 and the adjacent end of the engine. At this end of the engine, the crankshaft 26 is provided with a main bearing 95 that is journaled in the cylinder block in the aforedescribed manner and which has a diameter $D_1$. The diameter $D_1$ is smaller than a diameter $D_2$ defined by the counterweighted throws 96 and 97 of the crankshaft. The sprocket 46 is disposed adjacent the next main bearing of the crankshaft and hence will be disposed axially between these counterweighted throws 96 and 97.

The chain 47 is maintained under tension by a hydraulically operated chain tensioner 98 that bears against the return side of the chain 47 and urges it into engagement with a sprocket 99 that is affixed to a water pump drive shaft 101. The water pump drive shaft 101 drives an impeller 102 of a water pump assembly for circulating the water through the cooling jacket of the engine.

The drive side of the chain 47 is engaged by a bearing or guide surface 103 so as to limit chain movement. As may be readily seen from FIG. 9, the drive chain 47 and sprocket 48 at one end of the intermediate shaft 49 is disposed so as to extend into a recessed area of the cylinder wall 39 adjacent a pair of intake ports 104 which intake ports are served by the runners 59 as aforedescribed. The cylinders are indicated by the lines X1, X2, X3 in FIG. 9 and the relationship is shown clearly therein. As a result of this relationship, a very compact engine assembly is provided but nevertheless one which is easily serviceable.

It should be noted that the cylinder head 39 is provided with an embossment 105 that extends into this recess and which defines a cavity 106 that is closed by an access plate 107 that is readily removable for setting the timing of the valve train. Hence, a very simple and compact arrangement is provided. Because of the mounting of the intermediate shaft 49 in the cylinder head 39 rather than in the cylinder block 23, the drive chain 52 from the intermediate shaft to the camshafts 41 and 42 will be positioned so that it will not interfere with the bolt arrangement for holding the cylinder head 39 to the cylinder block 23. A hydraulic tensioner 108 is provided at one side of the cylinder head 39 and acts against the return side of the chain 52 for maintaining its tension. Bearing blocks 109 and 111 bear against the drive side of the chain 52 so as to maintain it in relationship with the respective sprockets 51 and 53.

Referring now to FIG. 7, a clutch assembly, indicated generally by the reference numeral 112 is, as aforenoted, associated with the flywheel 33. This clutch assembly includes a driven disk 113 that is splined to the primary shaft 114 of the change speed transmission 35. A pressure plate 115 is associated with this driven clutch plate 113 and is released by a release mechanism including fingers 116 in a known manner. It is, of course, desirable to provide a large diameter for the flywheel 33 and the clutch mechanism 112. As may be readily seen from FIG. 7, the diameter of the flywheel and clutch extends outwardly beyond the end of the crankshaft 26 since the flywheel is positioned axially outwardly of this end of the crankshaft, this being the bearing end 95. In addition, as may be seen in FIG. 9, the chain 52 and drive from the intermediate shaft 49 to the camshafts 41 and 42 is located axially beyond the flywheel clutch mechanism and over the transmission casing 38 so as to not encroach upon to this construction and to permit a large diameter. As a result, the construction permits a large diameter while maintaining ease of accessibility and servicing, as aforenoted.

Figure 12:
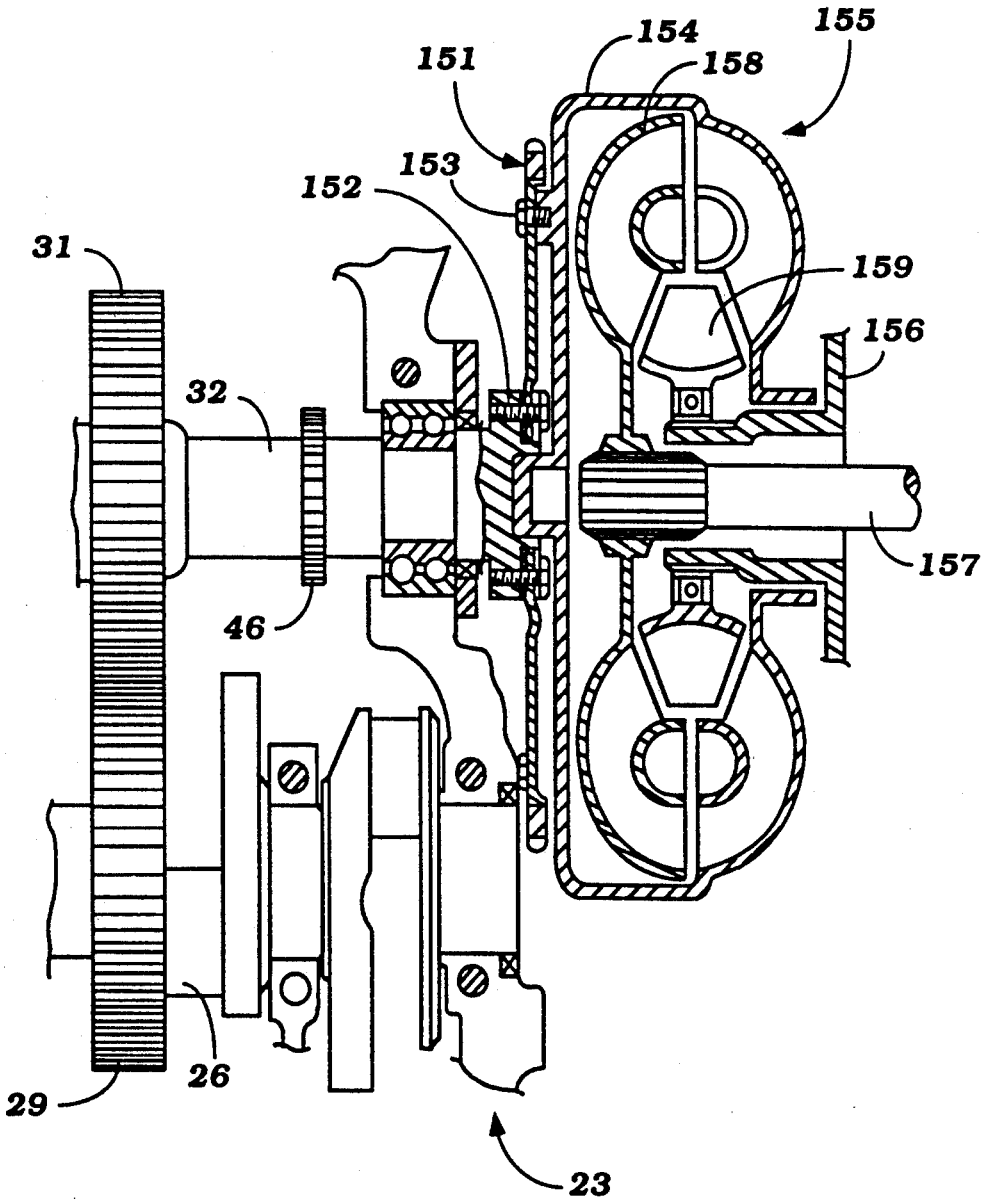
FIG. 12 is a partial view, in part similar to FIG. 7, showing another embodiment of the invention.

In the embodiment of the invention as thus far described, the invention has been described in conjunction with a manual change speed transmission having a frictional clutch. Of course, the invention can also be utilized in conjunction with power units having automatic transmissions and such an embodiment is shown in FIG. 12. Since only the transmission input number is important in considering this embodiment, only this portion of the construction has been illustrated and other components which are the same as the previously described embodiment have been identified by the same reference numerals. In this embodiment, a starter gear 51 is affixed, by fasteners 152 to the end of the output shaft 32. Further ,fasteners 153 affix the driving turbine 154 of a torque converter, indicated generally by the reference numeral 155, to this end of the output shaft 32. The associated automatic transmission has a casing 156 that journals an input shaft 157 thereof in a suitable manner. A driven turbine 158 cooperates with the driving turbine 154 and a stator 159 so as to drive the shaft 157 in a known manner.

It should be readily apparent from the foregoing of the described embodiments of the invention provide a very affective camshaft drive arrangement for an internal combustion engine and a servicing arrangement therefor. Of course, the described embodiments are only preferred embodiments of the invention and various changes and modifications may be made without departing from the spirit and scope of the invention, as defined by the appended claims.

We claim:

1. A camshaft drive arrangement for an engine having at least one cylinder closed by a cylinder head, a crankshaft driven by a piston contained with said one cylinder for rotation about a first axis, an intermediate shaft journaled for rotation by said cylinder head about a second axis parallel to said first axis, first drive means for driving said intermediate shaft from said crankshaft on one side of a first plane extending perpendicular to said first and said second axes and containing the axis of said cylinder, a camshaft journaled for rotation by said cylinder head about a third axis parallel to said first and said second axes for operating at least one valve associated with said cylinder head, and second drive means for driving said camshaft from said intermediate shaft on the other side of said first plane, said first and said second drive means comprising flexible transmitters.

2. A camshaft drive arrangement as set forth in claim 1 wherein at least one of the flexible transmitters comprises a chain.

3. A camshaft drive arrangement as set forth in claim 2 wherein both of the flexible transmitters comprise chains.

4. A camshaft drive arrangement as set forth in claim 1 wherein the engine has a plurality of cylinders and the one cylinder is an end cylinder of a plurality of aligned cylinders.

5. A camshaft drive arrangement for an engine having at least one cylinder, a crankshaft driven by a piston contained within said one cylinder rotation about a first axis, an intermediate shaft journaled for rotation about a second axis parallel to said first axis, first driven means for driving said intermediate shaft on one side of a plane extending perpendicular to said first and said second axes and containing the axis of said cylinder, a camshaft journaled for rotation about a third axis parallel to said first and said second axes for operating at least one valve associated with said cylinder, and second drive means for driving said camshaft from said intermediate shaft on the other side of said plane, said engine having a cylinder head defining a combustion chamber and said camshaft being journaled above said combustion chamber and the intermediate shaft is journaled at one side of said combustion chamber and below said third axis, said cylinder head including a plurality of ports extending through the one side of said cylinder head, one of said drive means being disposed between a pair of said ports, said intermediate shaft being contained within a cavity formed by said cylinder head, said cavity having an access opening formed between the ports for accessing the respective drive means.

6. A camshaft drive arrangement as set forth in claim 5 wherein the access opening is closed by a removable cover plate.

7. A camshaft drive arrangement as set forth in claim 6 wherein one of the drive means comprises a flexible transmitter.

8. A camshaft drive arrangement as set forth in claim 7 wherein both of the drive means comprise flexible transmitters.

9. A camshaft drive arrangement as set forth in claim 8 wherein at least one of the flexible transmitters comprises a chain.

10. A camshaft drive arrangement as set forth in claim 9 wherein both of the flexible transmitters comprise chains.

11. A camshaft drive arrangement as set forth in claim 6 wherein the first drive means includes an output shaft driven by the crankshaft and driving the intermediate shaft by a flexible transmitter.

12. A camshaft drive arrangement as set forth in claim 11 further including a flywheel fixed to the one end of the output shaft for driving a transmission.

13. A camshaft drive arrangement as set forth in claim 12 wherein the first and second drive means are offset from the flywheel.

14. A camshaft drive and cylinder head arrangement for an internal combustion engine comprising a camshaft journaled for rotation by said cylinder head for operating at least one valve located therein, a cam cover affixed to said cylinder head and enclosing said camshaft, an intermediate shaft journaled for rotation by said cylinder head at one side thereof, first drive means for driving said intermediate shaft from an output shaft of said engine, second drive means for driving said camshaft from said intermediate shaft, one of said drive means being located at one end of said engine, the other of said drive means being spaced from said one end of said cylinder head and remotely from the other end thereof, and removable access means other than said cam cover and carried by said cylinder head for offering access to said other drive means for servicing said other drive means.

15. A camshaft drive and cylinder head arrangement as set forth in claim 14 wherein one of the drive means comprises a flexible transmitter.

16. A camshaft drive and cylinder head arrangement as set forth in claim 15 wherein both of the drive means comprise flexible transmitters.

17. A camshaft drive and cylinder head arrangement as set forth in claim 16 wherein at least one of the flexible transmitters comprises a chain.

18. A camshaft drive and cylinder head arrangement as set forth in claim 17 wherein both of the flexible transmitters comprise chains.

19. A camshaft drive and cylinder head arrangement as set forth in claim 18 wherein the cylinder head includes a plurality of ports extending through the one side of the cylinder head and one of the drive means is disposed between a pair of the ports.

20. A camshaft drive and cylinder head arrangement as set fort in claim 14 wherein the cylinder head includes a plurality of ports extending through the one side of the cylinder head and one of the drive means is disposed between a pair of the ports.

21. A camshaft drive and cylinder head arrangement as set forth in claim 20 wherein the first drive means includes an output shaft driven by the crankshaft and driving the intermediate shaft by a flexible transmitter.

22. A camshaft drive and cylinder head arrangement as set forth in claim 21 further including a flywheel fixed to the one end of the output shaft for driving a transmission.

23. A camshaft drive and cylinder head arrangement as set forth in claim 22 wherein the first and second drive means are offset from the flywheel.

24. A camshaft drive and cylinder head arrangement as set forth in claim 23 wherein the engine has a plurality of cylinders and the one cylinder is an end cylinder of a plurality of aligned cylinders.

25. A camshaft drive arrangement as set forth in claim 14 wherein the one of the drive means comprises the first drive means and the other of the drive means comprises the second drive means.

26. A camshaft drive arrangement as set forth in claim 25 wherein the removable access means offers access to the intermediate shaft.

27. A camshaft drive and cylinder head arrangement for an internal combustion engine comprising a camshaft journaled for rotation by said cylinder head and operating a plurality of valves located therein, an intermediate shaft journaled for rotation by said cylinder head at one side thereof, a plurality of ports opening through said one side of said cylinder head, first drive means for driving said intermediate shaft from said output shaft of said engine, second drive means for driving said camshaft from said intermediate shaft, one of said drive means being located at one end of said cylinder head, the other of said drive means being positioned at least in part at the side of said cylinder head and between a pair of said ports.

28. A camshaft drive and cylinder head arrangement as set forth in claim 27 wherein the intermediate shaft is contained within a cavity formed by the cylinder head and the cavity has an access opening formed between the ports for accessing the respective drive means.

29. A camshaft drive and cylinder head arrangement as set forth in claim 28 wherein the access opening is closed by a removable cover plate.

30. A camshaft drive and cylinder head arrangement as set forth in claim 29 wherein one of the drive means comprises a flexible transmitter.

31. A camshaft drive and cylinder head arrangement as set forth in claim 30 wherein both of the drive means comprise flexible transmitters.

32. A camshaft drive and cylinder head arrangement as set forth in claim 31 wherein at least one of the flexible transmitters comprises a chain.

33. A camshaft drive and cylinder head arrangement as set forth in claim 32 wherein both of the flexible transmitters comprise chains.

34. A camshaft drive arrangement for an internal combustion engine having a crankshaft, an output shaft driven by said crankshaft about a first axis, a flywheel affixed for rotation at one end of said output shaft, an intermediate shaft journaled by said engine for rotation about a second axis parallel to said first axis, means offset from said flywheel for driving said intermediate shaft from said output shaft adjacent one end thereof, a camshaft journaled for rotation about a third axis parallel to said first and said second axes, and means for adjacent but offset from said flywheel for driving said camshaft from said intermediate shaft.

35. A camshaft drive arrangement for a vehicular engine having at least one cylinder, a crankshaft driven by a piston contained within said one cylinder for rotation about a first axis, an output shaft for driving the vehicle journaled for rotation about an output shaft axis parallel to said first axis and driven by said crankshaft, an intermediate shaft journaled for rotation about a second axis parallel to said first axis, first drive means for driving said intermediate shaft from said output axis, on one side of a plane extending perpendicular to said first and said second axes and containing the axis of said cylinder, a camshaft journaled for rotation about a third axis parallel to said first and said second axes for operating at least one valve associated with said cylinder, and second drive means for driving said camshaft from said intermediate shaft on the other side of said plane.

36. A camshaft drive arrangement as set forth in claim 35 wherein one of the drive means comprises a flexible transmitter.

37. A camshaft drive arrangement as set forth in claim 36 wherein both of the drive means comprise flexible transmitters.

38. A camshaft drive arrangement as set forth in claim 37 wherein at least one of the flexible transmitters comprises a chain.

39. A camshaft drive arrangement as set forth in claim 38 wherein both of the flexible transmitters comprise chains.

40. A camshaft drive arrangement as set forth in claim 35 wherein the cylinder head includes a plurality of ports extending through the one side of the cylinder head and one of the drive means is disposed between a pair of the ports.

41. A camshaft drive arrangement as set forth in claim 40 wherein the intermediate shaft is contained with a cavity formed by the cylinder head and the cavity has an access opening formed between the ports for accessing the respective drive means.

42. A camshaft drive arrangement as set forth in claim 41 wherein the access opening is closed by a removable cover plate.

43. A camshaft drive arrangement as set forth in claim 35 further including a flywheel fixed to the one end of the output shaft for driving a transmission.

44. A camshaft drive arrangement as set forth in claim 43 wherein the first and second drive means are offset from the flywheel.

45. A camshaft drive arrangement for an engine having at least one cylinder closed by a cylinder head, a crankshaft driven by a piston contained within said one cylinder for rotation about a first axis, an intermediate shaft journaled for rotation by said cylinder head about a second axis parallel to said first axis and disposed at one side of said cylinder head, first drive means for driving said intermediate shaft from said crankshaft, on one side of a plane extending perpendicular to said first and said second axes and containing the axis of said cylinder, a first and second camshafts journaled for rotation by said cylinder about a respective third and fourth axes parallel to said first and said second axes each of said camshafts operating at least one valve associated with said cylinder head, and second drive means for driving said camshafts from said intermediate shaft on the other side of said plane.

46. A camshaft drive arrangement as set forth in claim 45 wherein one of the drive means comprises a flexible transmitter.

47. A camshaft drive arrangement as set forth in claim 46 wherein both of the drive means comprise flexible transmitters.

48. A camshaft drive arrangement as set forth in claim 47 wherein at least one of the flexible transmitters comprises a chain.

49. A camshaft drive arrangement as set forth in claim 48 wherein both of the flexible transmitters comprise chains.

50. A camshaft drive arrangement as set forth in claim 45 wherein the cylinder head includes a plurality of ports extending through the one side of the cylinder head and one of the drive means is disposed between a pair of the ports.

51. A camshaft drive arrangement as set forth in claim 50 wherein the intermediate shaft is contained with a cavity formed by the cylinder head and the cavity has an access opening formed between the ports for accessing the respective drive means.

52. A camshaft drive arrangement as set forth in claim 51 wherein the access opening is closed by a removable cover plate.

53. A camshaft drive arrangement as set forth in claim 52 wherein one of the drive means comprises a flexible transmitter.

54. A camshaft drive arrangement as set forth in claim 53 wherein both of the drive means comprise flexible transmitters.

55. A camshaft drive arrangement as set forth in claim 54 wherein at least one of the flexible transmitters comprises a chain.

56. A camshaft drive arrangement as set forth in claim 55 wherein both of the flexible transmitters comprise chains.

57. A camshaft drive arrangement as set forth in claim 52 wherein the first drive means includes an output shaft driven by the crankshaft and driving the intermediate shaft by a flexible transmitter.

58. A camshaft drive arrangement as set forth in claim 57 further including a flywheel fixed to the one end of the output shaft for driving a transmission.

59. A camshaft drive arrangement as set forth in claim 58 wherein the first and second drive means are offset from the flywheel.

60. A camshaft drive arrangement as set forth in claim 45 wherein the engine has a plurality of cylinders and the one cylinder is an end cylinder of a plurality of aligned cylinders.

* * * * *